US007330114B2

(12) United States Patent
Finlayson

(10) Patent No.: US 7,330,114 B2
(45) Date of Patent: Feb. 12, 2008

(54) ELECTRONIC SECURITY AND MONITORING SYSTEM

(75) Inventor: John Finlayson, Queensland (AU)

(73) Assignee: Aleis Trakit Pty Ltd., Queensland (AU)

( * ) Notice: Subject to any disclaimer, the term of this patent is extended or adjusted under 35 U.S.C. 154(b) by 132 days.

(21) Appl. No.: 10/545,536

(22) PCT Filed: Feb. 12, 2004

(86) PCT No.: PCT/AU2004/000163

§ 371 (c)(1),
(2), (4) Date: Aug. 12, 2005

(87) PCT Pub. No.: WO2004/072917

PCT Pub. Date: Aug. 26, 2004

(65) Prior Publication Data

US 2006/0202822 A1 Sep. 14, 2006

(30) Foreign Application Priority Data

Feb. 13, 2003 (AU) ..... 20033900627

(51) Int. Cl.
*G08B 13/00* (2006.01)

(52) U.S. Cl. ..... 340/541; 340/5.3; 340/539.11; 340/573.4

(58) Field of Classification Search ..... 340/573.1, 340/573.4, 572.1, 572.4, 539.11, 539.13, 340/5.2, 5.3, 5.61, 5.64, 5.52, 5.53, 5.82, 340/5.83, 10.4, 10.42, 825.49, 541; 235/375, 235/382, 385

See application file for complete search history.

(56) References Cited

U.S. PATENT DOCUMENTS

| | | | | |
|---|---|---|---|---|
| 3,891,980 | A * | 6/1975 | Lewis et al. | 340/5.62 |
| 5,426,425 | A * | 6/1995 | Conrad et al. | 340/825.49 |
| 5,682,142 | A * | 10/1997 | Loosmore et al. | 340/572.1 |
| 6,057,764 | A | 5/2000 | Williams | |
| 6,335,688 | B1 * | 1/2002 | Sweatte | 340/573.1 |
| 6,661,343 | B1 | 12/2003 | Rocci | |
| 6,707,374 | B1 * | 3/2004 | Zaharia | 340/5.31 |
| 2002/0082859 | A1 * | 6/2002 | Lancos et al. | 705/1 |

FOREIGN PATENT DOCUMENTS

| | | |
|---|---|---|
| EP | 0 287402 | 10/1988 |
| GB | 2 095 016 | 9/1982 |
| GB | 2 387 744 | 10/2003 |
| WO | WO 02/11096 | 2/2002 |

* cited by examiner

*Primary Examiner*—Thomas Mullen
(74) *Attorney, Agent, or Firm*—Fulwider Patton LLP

(57) ABSTRACT

A security system including in combination a signal transmitter carried by an object wherein the signal transmitter is adapted to transmit a signal, a signal receiver adapted to receive signals, transmitted by the signal transmitter, a control unit adapted to process received signals and adapted to control an alarm system in accordance to the received signals, wherein the control unit in response to a processed received signal from the signal transmitter controls the alarm system such that the presence of objects with the signal transmitter in a designated area will not activate the alarm of the alarm system, however the control unit continues to allow the alarm of the alarm system to be activated if the alarm system senses objects without the signal transmitter in the designated area.

8 Claims, 3 Drawing Sheets

ELECTRONIC SECURITY AND MONITORING SYSTEM

RELATED APPLICATIONS

This is a U.S. national phase of PCT/AU2004/000163 filed 12 Feb. 2004, claiming priority from Australian Patent Application No. AU 2003900627 filed Feb. 13, 2003.

FIELD OF THE INVENTION

This invention relates to security systems in particular, but not limited to an electronic security and monitoring system to monitor the presence of unauthorized individuals in designated areas.

BACKGROUND OF THE INVENTION

Home security is a growth industry with the increase in crime rate universally experienced in major cities all over the world. There is a tendency for criminals to target defenseless people (such as the elderly) or property. Prior security systems are known which include alarm systems incorporating motion sensing, infrared and other similar detectors, which react to the presence of unauthorized persons.

The disadvantage and limitations of these prior art systems include the need to switch them off when authorized occupants are in the home or in the vicinity of the designated areas so that the alarm is not accidentally or unintentionally triggered. In some cases, the turning off of an accidentally activated alarm can cost the homeowner a fee, which is levied by the security monitoring company in the form of a 'false alarm' callout fee. The setting off of false alarms can result in neighborhood disturbances as the sirens and bells utilised are usually designed to be very noisy for the obvious reasons.

In addition, false alarms can be accidentally triggered by the movement of animals such as pets, which are left at home by their owners. The owners and their guest themselves often trigger the alarm systems by forgetting to switch them off when re-occupying the premises. The applications for home security also apply to industrial situations, where designated areas normally only to be accessed by authorized personnel are also protected by an alarm system. In both cases, there is also a benefit if the movement of an unauthorized employee or intruder can be monitored.

There is a need to provide a security system that provides comfort and security to the persons using it and allowing them to feel safe in their homes or place of work/business.

OBJECT OF THE INVENTION

It is therefore an object of the invention to provide an improved security system or to at least provide the public with a useful choice.

STATEMENT OF THE INVENTION

In one aspect, the invention resides in a security system including in combination:

(i) signal transmission means carried by an object wherein said signal transmission means is adapted to transmit a signal;

(ii) signal receiver means adapted to receive signals, transmitted by the signal transmission means;

(iii) control means adapted to process received signals and adapted to control an alarm system in accordance to the received signals;

wherein the control means in response to a processed received signal from said signal transmission means controls the alarm system such that the presence of objects with said signal transmission means in a designated area will not activate the alarm of the alarm system, however the control means continues to allow the alarm of the alarm system to be activated if the alarm system senses objects without signal transmission means in the designated area.

Preferably the security system can be used in conjunction with existing prior art alarm systems and can be supplied as an after market accessory to the prior art alarm systems.

Preferably the signal transmission means is a miniaturized transponder or transmitter that can be worn anywhere on the body or object as a pendent for a necklace, a bracelet, an attachment to wristwatch band, an identification card on a belt clip or around the neck etc.

Preferably the receiver means includes antenna means to detect the signal, typically a radio or microwave or ultra high frequency signal.

Preferably the control means is a computerized means adapted to process the signal received by the receiver means and to control and co-ordinate the security system and existing prior security alarm systems in order not to activate the alarm of the alarm system when objects with signal transmission means are present in the designated area and to activate the alarm of the alarm system if objects without signal transmission means are sensed in the designated area.

Preferably the computerized means is part of a home security system, which typically involves an Internet user controlled system.

Preferably the antenna means can be disguised in a picture frame or any other suitable fittings or fixtures or be part of the motion sensing apparatus of an existing alarm system.

Preferably the transponder or transmitter means is unique to the wearer or user and only the wearer or user can activate the transmitter or transponder.

Preferably the computer or control means also monitors the number of and s the position of the signal received so that the number of times the wearer or user enters a designated area and the movements of the wearer or user within the designated area can be recorded.

Preferably the security system is adapted to be used in combination with known biometric systems, typically face recognition systems or video or digital imaging systems to enable the identification of a wearer of a transmission means to be verified.

Preferably the security system is powered by the same power supply as the alarm system.

Preferably the control means is adapted to record and acknowledge a particular I.D. for each transmission means.

Preferably the security system is adapted to be an 'idle mode' and the alarm system fully armed when objects with transmission means are not in the designated area and is adapted to be instantaneously 'active' when a signal from a transmission means in the designated' area is received by the signal receiver means.

In a further aspect, the invention resides in a security system including in combination:

(i) signal transmission means carried by an object wherein said signal transmission means is adapted to transmit a signal;

(ii) signal receiver means adapted to receive signals, transmitted by the signal transmission means;

(iii) control means adapted to process received signals and adapted to control an alarm system in accordance to the received signals;

wherein the control means in response to a processed received signal from said signal transmission means controls the alarm system such that the presence of objects with said signal transmission means, the alarm of the alarm system in a designated area will be deactivated.

Preferably the control means is adapted to allow other alarms of the alarm system in other designated areas to remain active when an object with a transmission means is in the designated area.

Preferably the control means is adapted to allow the alarm of the alarm system to be activated if the alarm system senses objects without signal transmission means in the designated area even if an object with a transmission means is also in the designated area.

BRIEF DESCRIPTION OF THE DRAWINGS

In order the invention to be better understood and put in practical effect reference will now be made to the drawings wherein.

DETAILED DESCRIPTION OF THE DRAWINGS

Figure 1:
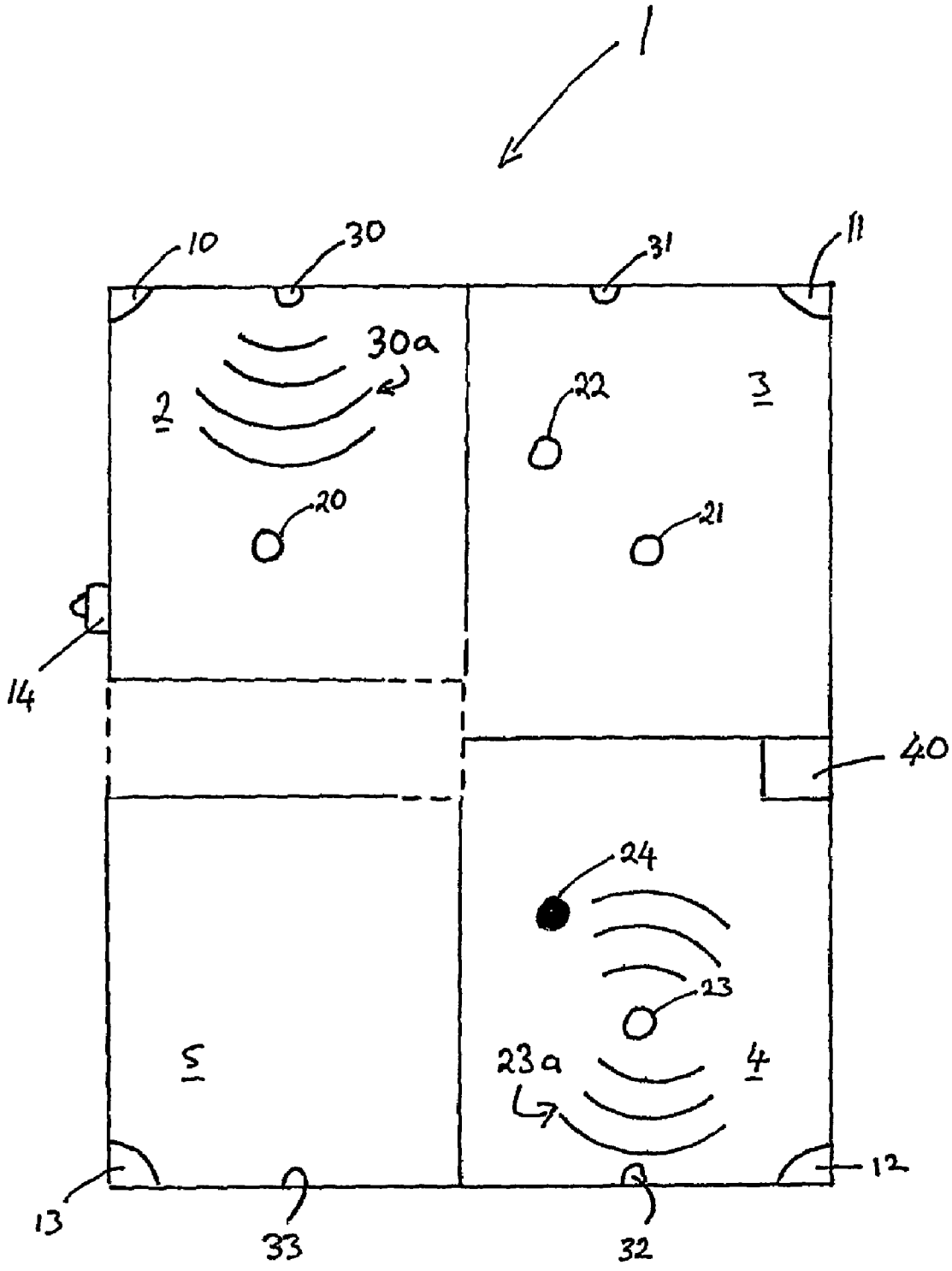
FIG. 1 shows a schematic plan view of the invention in use.

Referring now to FIG. 1 there is shown a schematic plan view of the invention in use. A transmitter or transponder carried by an authorized occupant of an area, typically a building 1, can move freely (i.e. move from various rooms 2, 3, 4, 5 in the building) without activating an armed alarm system 10, 11, 12, 13, 14. The signal 23*a*, 30*a* from transponders or transmitters 20, 21, 22, 23 overrides the operation of motion detectors 10, 11, 12, 13 or other type of detector in a particular area so that the occupant carrying the transmitter or transponder does not activate the alarm system.

The antenna 30, 31, 32, 33 of the receiver means can be associated with a motion sensor detector alarm system or any other type alarm system sensors already installed in the building which is connected to a computerized control unit 40 which co-ordinates with the alarm system 10, 11, 12, 13, 14. The antenna of the receiver means can also be situated in any furniture fitting or fixture or wall hangings or light fittings.

As the individual carrying the transponder or transmitter 20, 21, 22, 23 moves through different rooms 2, 3, 4, 5 in the building the computerized control unit 40 in response to a received signal 23*a*, 30*a* from the transponder or transmitter carried by the individual overrides the alarm 14 so that the individual can roam freely without activating the alarm 14. However any other individual 24 not carrying a transponder or transmitter will activate the alarm 14 even if an individual with a transponder or transmitter 23 is present in the same room 4 or in another part of an alarmed building.

The computerized control unit 40 preferably can record the number of times the alarm system is deactivated and/or reactivated in any one room and also records the movement of individuals carrying transponders or transmitters as they move through the alarmed building. The computerized control unit can also record and acknowledge a particular I.D. for each transponder or transmitter.

The security system can be used in combination with known biometric systems, typically face recognition systems or video or digital imaging systems to enable the identification of a wearer of a transmission means to be verified.

The security system can be powered by the same power supply as the alarm system.

The security system can be placed in an 'idle mode' while the alarm system is fully armed when an individual with a transponder or transmitter is not in the alarmed area and becomes instantaneously 'active' when an individual with a transponder or transmitter enters an alarmed area.

FIGS. 2*a*-2*e* show various preferred embodiments of the signal transmission means, in the form of wearable transmitters or transponders.

Figures 2A, 2B, 2C:
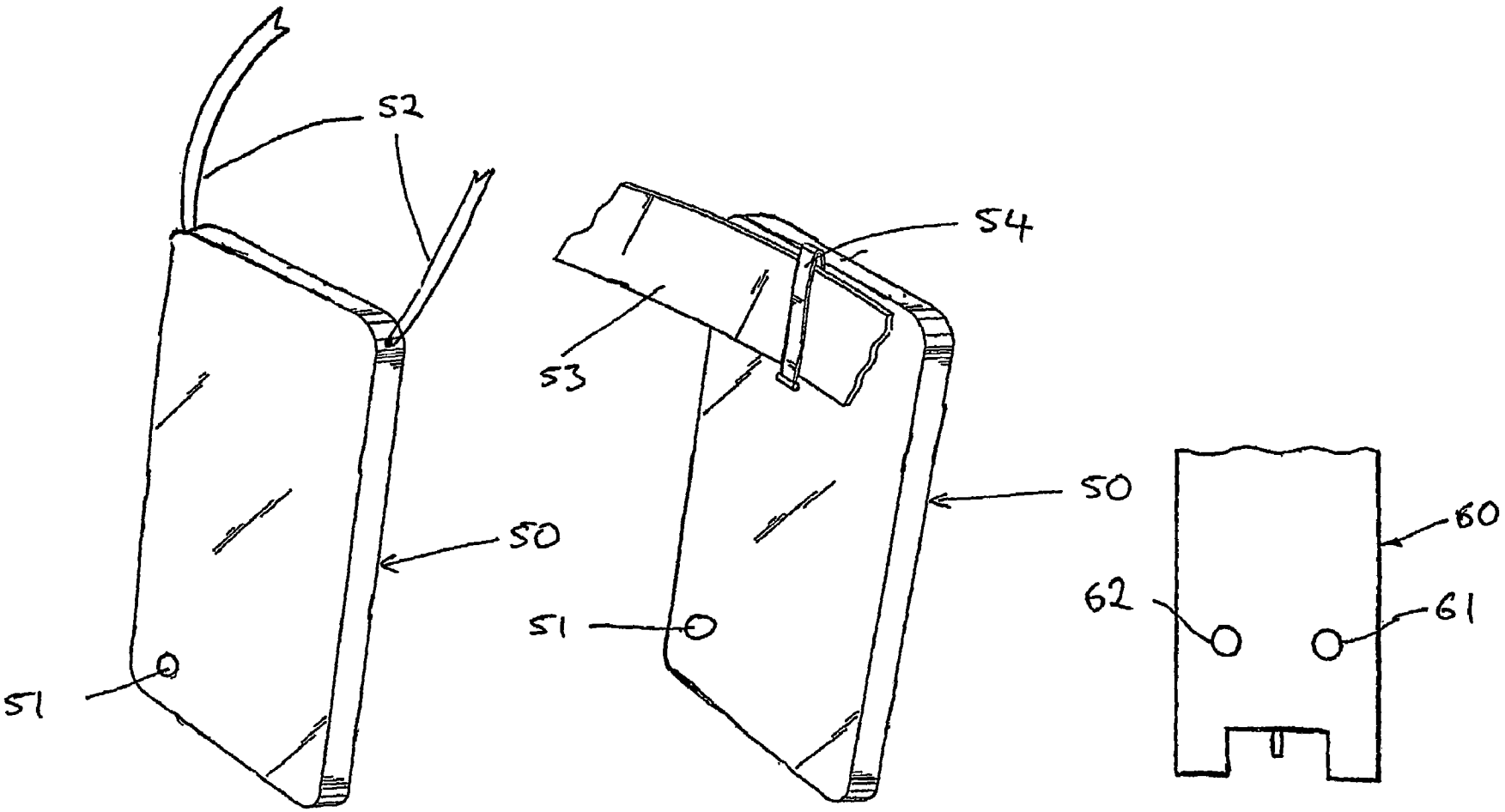
FIG. 2*a*-2*e* show various preferred embodiments of preferred signal transmission means according to the invention.

In FIG. 2*a* there is shown an identification tag 50 for a wearer to wear around his or her neck by way of strap 52. The identification tag has a transponder or transmitter 51 either externally on or internally within the identification tag 50. FIG. 2*b* shows the identification tag 50 of FIG. 2*a* worn with a belt clip 54 or attachable to the belt 53 or a pocket of a garment.

FIG. 2*c* shows the transponder or transmitter 61, 62 on a strap 60 typically a watchstrap.

Figure 2D:
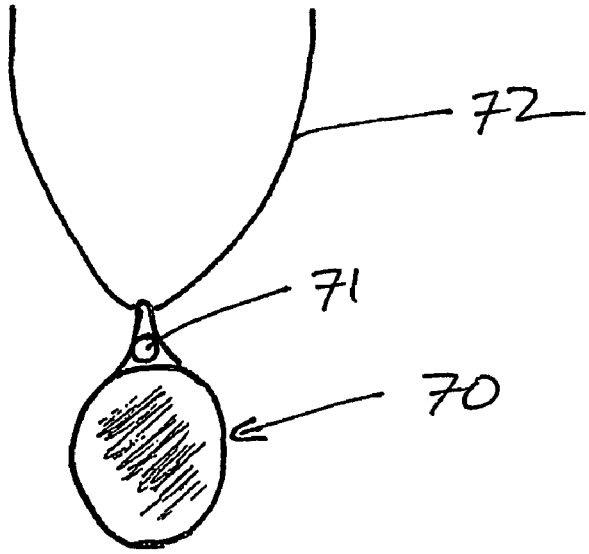

FIG. 2*d* shows a pendent 70 to be worn on a necklace 72 where the pendant has a transponder or transmitter 71 positioned on or in the pendant 70.

Figure 2E:
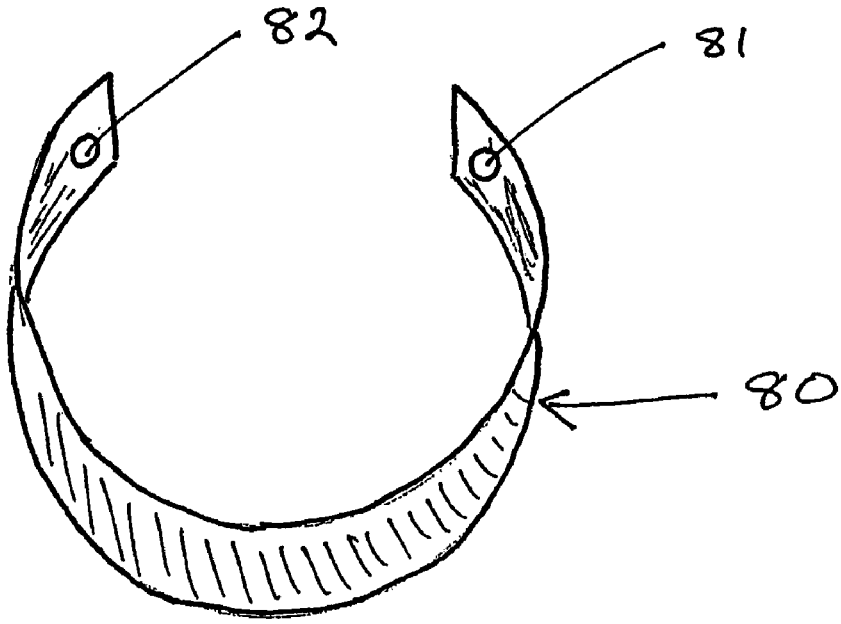
Figure 1:
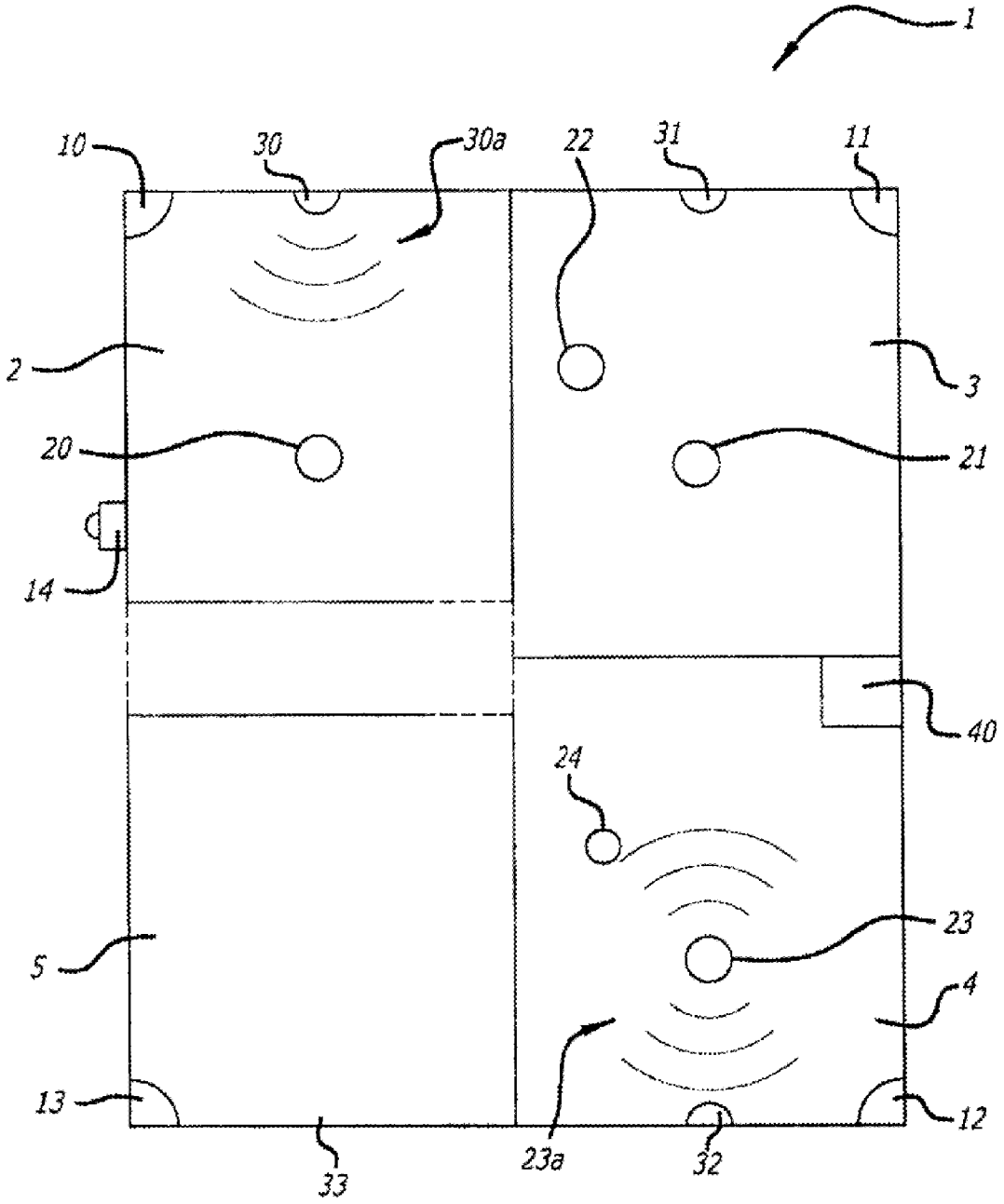
Figure 2C:
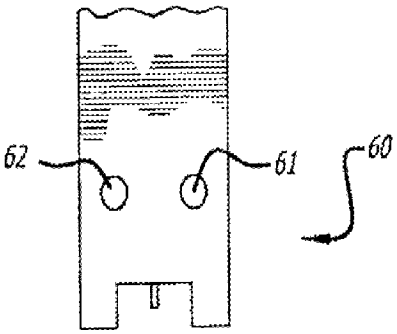
Figure 2B:
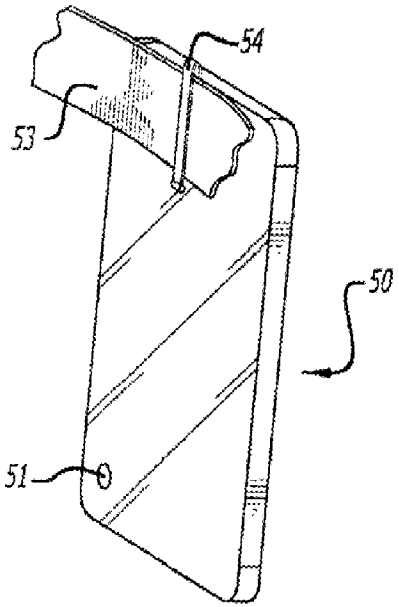
Figure 2A:
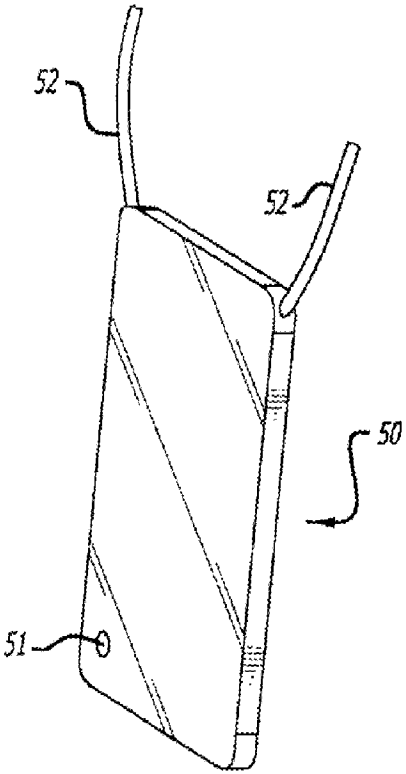
Figure 2D:
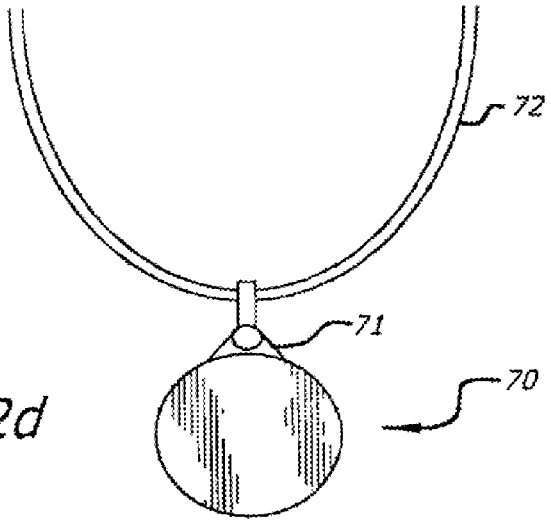
Figure 2E:
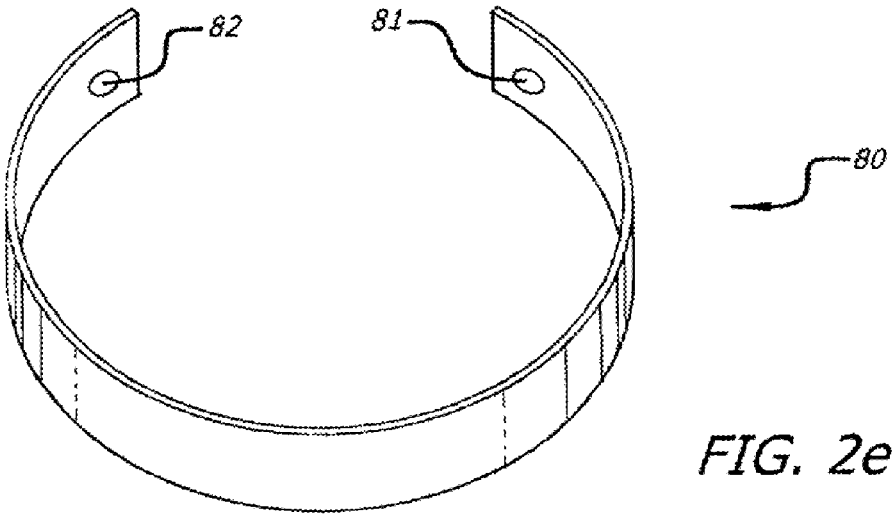

FIG. 2*e* shows bracelet 80 having a transponder or transmitter 81, 82 positioned on or in the bracelet 80.

Advantages

Alarm system is always fully alarmed.

No need to turn off alarm when entering an alarmed area.

Allows free and unrestricted movement throughout alarmed area for authorized individuals, animals, machinery, vehicles, etc.

Able to be used with known alarm systems

Allows for monitoring of the movement of individuals in an alarmed area.

Provides added security and peace of mind to individuals in and/or entering an alarmed area.

Variations

It will of course be realised that while the foregoing has been given by way of illustrative example of this invention, all such and other modifications and variations thereto as would be apparent to persons skilled in the art are deemed to fall within the broad scope and ambit of this invention as is herein set forth.

Throughout the description and claims this specification the word "comprise" and variations of that word such as "comprises" and "comprising", are not intended to exclude other additives, components, integers or steps.

The invention claimed is:

1. A security system including in combination:

a. signal transmission means carried by an object wherein said signal transmission means is adapted to transmit a signal;

b. signal receiver means adapted to receive signals, transmitted by the signal transmission means;

c. control means adapted to process received signals and adapted to control an alarm in accordance to the received signals;

d. wherein the control means in response to a processed signal from the transmission means controls the alarm such that the presence of objects with said signal transmission means in a designated area will not activate the alarm, however the alarm will be activated if the security system senses objects without signal transmission means in the designated area even if an object with said signal transmission means is also present in the designated area; and e. further wherein the control means also monitors and records the number of times an object with a signal transmission means enters a designated area and the movements of the object through the designated area.

2. A security system as claimed in claim 1, wherein the signal transmission means is a miniaturized transponder or transmitter.

3. A security system as claimed in claim 2, wherein the transponder or transmitter is unique to a wearer and only the wearer can activate the transmitter or transponder.

4. A security system as claimed in claim 1, wherein the control means is a computerized means adapted to process the signals received by the receiver means and to control and co-ordinate the security system in order not to activate the alarm when objects with signal transmission means are present in the designated area and to activate the alarm if objects without signal transmission means are sensed in the designated area.

5. A security system as claimed in claim 1, wherein the receiver means includes antenna means to detect the signal.

6. A security system as claimed in claim 1, wherein the security system and the alarm are powered by a common power supply.

7. A security system as claimed in claim 1, wherein each transmission means has a particular I.D.

8. A security system as claimed in claim 1, wherein the alarm is fully armed when objects with transmission means are not in the designated area.

* * * * *

UNITED STATES PATENT AND TRADEMARK OFFICE

CERTIFICATE OF CORRECTION

PATENT NO. : 7,330,114 B2
APPLICATION NO. :10/545536
DATED : February 12, 2008
INVENTOR(S) : John Finlayson It is certified that error appears in the above-identified patent and that said Letters Patent is hereby corrected as shown below:

Delete title page illustrating figure, and substitute therefor new title page illustrating figure (attached).

Delete drawing sheets 1-3, and substitute therefor drawing sheets 1-3, as shown on the attached sheets.

Column 2, line 41, after “and” delete “s”.

Column 3, line 21, delete “In order the” and insert --In order for the--.

Signed and Sealed this

Twelfth Day of August, 2008

JON W. DUDAS
*Director of the United States Patent and Trademark Office*

(12) United States Patent
Finlayson

(10) Patent No.: US 7,330,114 B2
(45) Date of Patent: Feb. 12, 2008

(54) ELECTRONIC SECURITY AND MONITORING SYSTEM

(75) Inventor: John Finlayson, Queensland (AU)

(73) Assignee: Alcis Trakit Pty Ltd., Queensland (AU)

( * ) Notice: Subject to any disclaimer, the term of this patent is extended or adjusted under 35 U.S.C. 154(b) by 132 days.

(21) Appl. No.: 10/545,536

(22) PCT Filed: Feb. 12, 2004

(86) PCT No.: PCT/AU2004/000163

§ 371 (c)(1),
(2), (4) Date: Aug. 12, 2005

(87) PCT Pub. No.: WO2004/072917

PCT Pub. Date: Aug. 26, 2004

(65) Prior Publication Data

US 2006/0202822 A1 Sep. 14, 2006

(30) Foreign Application Priority Data

Feb. 13, 2003 (AU) ..... 2003390627

(51) Int. Cl.
*G08B 13/00* (2006.01)

(52) U.S. Cl. ..... 340/841; 340/5.3; 340/539.11; 340/573.4

(58) Field of Classification Search ..... 340/573.1, 340/573.4, 572.1, 572.4, 539.11, 539.13, 340/5.2, 5.3, 5.61, 5.64, 5.52, 5.53, 5.82, 340/5.83, 10.4, 10.42, 825.49, 541; 235/375, 235/382, 385

See application file for complete search history.

(56) References Cited

U.S. PATENT DOCUMENTS

| | | | | |
|---|---|---|---|---|
| 3,891,980 | A * | 6/1975 | Lewis et al. | 340/5.62 |
| 5,426,425 | A * | 6/1995 | Conrad et al. | 340/825.49 |
| 5,682,142 | A * | 10/1997 | Loosmore et al. | 340/572.1 |
| 6,057,764 | A | 5/2000 | Williams | |
| 6,335,688 | B1 * | 1/2002 | Sweatte | 340/573.1 |
| 6,661,343 | B1 | 12/2003 | Recci | |
| 6,707,374 | B1 * | 3/2004 | Zahavia | 340/5.31 |
| 2002/0082839 | A1 * | 6/2002 | Lancos et al. | 705/1 |

FOREIGN PATENT DOCUMENTS

| | | |
|---|---|---|
| EP | 0 287402 | 10/1988 |
| GB | 2 095 016 | 9/1982 |
| GB | 2 387 744 | 10/2003 |
| WO | WO 02/11096 | 2/2002 |

* cited by examiner

*Primary Examiner*—Thomas Mullen
(74) *Attorney, Agent, or Firm*—Fulwider Patton LLP

(57) ABSTRACT

A security system including in combination a signal transmitter carried by an object wherein the signal transmitter is adapted to transmit a signal, a signal receiver adapted to receive signals, transmitted by the signal transmitter, a control unit adapted to process received signals and adapted to control an alarm system in accordance to the received signals, wherein the control unit in response to a processed received signal from the signal transmitter controls the alarm system such that the presence of objects with the signal transmitter in a designated area will not activate the alarm of the alarm system, however the control unit continues to allow the alarm of the alarm system to be activated if the alarm system senses objects without the signal transmitter in the designated area.

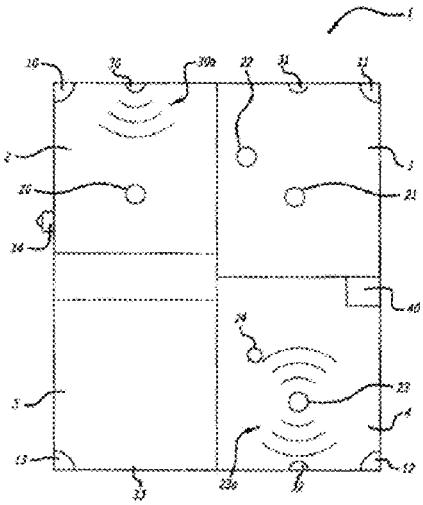

8 Claims, 3 Drawing Sheets